United States Patent [19]

Lo Duca

[11] Patent Number: 4,967,911

[45] Date of Patent: Nov. 6, 1990

[54] PARALLELEPIPED BOX FOR TEAR-OFF STRIP MATERIAL IN ROLL FORM

[75] Inventor: Carmelo Lo Duca, Milan, Italy

[73] Assignee: GI.BI.EFFE S.r.l., Milan, Italy

[21] Appl. No.: 436,481

[22] Filed: Nov. 14, 1989

[30] Foreign Application Priority Data

Nov. 18, 1988 [IT] Italy ..... 22670 A/88

[51] Int. Cl.[5] ..... B65D 5/54

[52] U.S. Cl. ..... 206/626; 206/395; 206/621

[58] Field of Search ..... 206/395, 621, 626

[56] References Cited

U.S. PATENT DOCUMENTS

| | | | |
|---|---|---|---|
| 2,096,107 | 10/1937 | Haggerty | 206/395 |
| 2,314,849 | 3/1943 | Sullivan et al. | 206/395 |
| 3,193,427 | 7/1965 | Rogers | 206/395 |
| 3,591,071 | 7/1971 | Rosenberg, Jr. | 206/626 |
| 4,405,066 | 9/1983 | Roccaforte | 206/395 |
| 4,417,678 | 11/1983 | Roccaforte | 206/395 |
| 4,431,139 | 2/1984 | Barnsbee et al. | 206/395 |
| 4,549,689 | 10/1985 | Bailey | 206/395 |

*Primary Examiner*—Gary E. Elkins

*Attorney, Agent, or Firm*—Ladas & Parry

[57] ABSTRACT

A parallelepiped box (400) containing a roll of tear-off strip material and provided with a device for tearing off a portion of said strip is formed from a punched element (310). The box comprises one (128) or two (128 and 158) toothings which are formed in the cardboard of the punched element and when the box has been assembled correspond with that (28) of the long corners of the box which is opposite the long corner (24) about which the box lid rotates once the box has been opened.

The toothings can be non-continuous, in which case the relative untoothed portions of one toothing can correspond with the toothed portions of the other.

A strip of the cardboard punched element (310) comprising a relative toothing (128, 158) can be treated with a substance able to harden the cardboard.

13 Claims, 1 Drawing Sheet

PARALLELEPIPED BOX FOR TEAR-OFF STRIP MATERIAL IN ROLL FORM

This invention relates to the known boxes of elongated parallelepiped form containing a roll of tear-off strip material, usually a material suitable for wrapping foods. More particularly, the invention relates to the device for facilitating tear-off of a portion of strip.

For a proper understanding of the present invention, a typical box of this type will be described in detail. It is assembled from a punched sheet element comprising four main parallel adjacent portions formed from substantially equal rectangles which are separated from each other by creasing lines along the longer sides of said rectangles. The punched element also comprises a secondary portion substantially equal in shape and dimensions to said main portions and adjacent to one of the two most outer main portions of the punched element, with which it has one of its longer sides in common, along which a creasing line is provided.

Each of the main portions and the secondary portion comprise a pair of opposing flaps, one at each end, to be folded about a creasing line provided along the relative short side of the portion concerned. These flaps have various shapes and sizes.

On that main portion adjacent to the only main portion having a free long side there is provided, adjoining the creasing line separating said two portions, an aluminium blade having toothing substantially corresponding with said creasing line, the points of the teeth of said toothing projecting just beyond said creasing line.

Said secondary portion of the punched sheet is divided longitudinally into two parts by a tearing line, the outer of these parts being removable by tearing it away from the box when assembled, so opening it. The remaining part of the secondary portion together with the adjacent main portion and the relative opposing flaps form the box lid, rotatable about the creasing line which divides the lid-forming main portion from the adjacent main portion.

When the box has been assembled, said toothing is located in a position corresponding with that long corner of the box which is opposite that about which the box lid can rotate.

The cost of the described known box is heavily penalised by the presence of said blade.

In FR-A-2,332,218 it has been sought to obviate this drawback by a device consisting of two superposed but staggered parallel toothings formed by suitably cutting through and folding a relative punched cardboard element. This latter is impregnated in the toothing region with a hardening substance to prevent the teeth fraying and losing their effectiveness after the first few tear-off operations.

It has however been found that, especially if the box contains a very long roll of strip, said separation device loses its effectiveness after a certain number of tear-off operations because the teeth of the toothing tend to bend, even though impregnated with hardener. This is due to the excessive amount by which said teeth project.

The object of the present invention is to provide a box of the said type which has a strip separation device forming a direct part of the punched element, as in FR-A-2,332,218, but which is still effective after a considerable number of tear-off operations, so that the device can be used even for very long rolls of strip.

Said object is attained according to the present invention by a box formed from a punched sheet element which, in correspondence with the creasing line forming that long corner of the box lying opposite the corner about which the box lid can rotate when the box is open, comprises toothing formed by cutting through the punched element, characterised in that all or part of that edge strip of said secondary portion of the punched element on the same side as said toothing remains fixed to the underlying relative main portion when the box has been assembled, even after the box is opened, and that the points of the teeth of said teething lie in the plane containing the outer surface of said strip or project just beyond said plane. In this manner the tooth of the teething are efficiently protected against any accidental impact which could damage them. If the cardboard from which the punched element is formed is rather than, this latter can comprise one or more longitudinal flaps adjacent to the more outer long side of said secondary portion and separated from this latter by a creasing line, when the box has been assembled said longitudinal flap or flaps being interposed between said secondary portion and the relative underlying main portion of the punched element. The overall thickness obtained by folding said longitudinal flap or flaps below the secondary portion into contact with the relative main portion must in all cases be less than or at most equal to the amount by which the teeth of the toothing project. In this manner, even in the case of fairly thin cardboard, a thickness sufficient to effectively protect the toothing teeth and reinforce that region of the box is obtained.

According to a further embodiment of the present invention, if said longitudinal flap or flaps are not provided, the free edge of the secondary portion can itself comprise toothing, called hereinafter the second toothing, the points of said second toothing, when the box has been assembled, lying substantially in the plane of the outer surface of that adjacent main portion opposite the box lid, or just projecting beyond said plane. This is again to protect the relative teeth from damage due to accidental impact.

If said longitudinal flaps are present the second toothing can still be provided in the punched element, as in the case of the first toothing, in correspondence with the creasing line which separates the secondary portion from said longitudinal flap or flaps which, when the box has been assembled, are always folded below the secondary portion. The teeth of said second toothing will again project a minimum or substantially zero distance beyond the outer surface of the secondary portion.

Both the first and the second toothing can conveniently be of intermittent type, with the relative portions of the two toothings alternating. As in FR-A-2,332,218, that strip of cardboard which contains relative toothing can be treated with a substance for hardening the cardboard of said strip. In this case the tear-off device of the present invention will remain efficient for a particularly large number of tear-off operations, which can be particularly useful in the case of large-diameter rolls of strip to be torn off. In this respect, the hardening substance prevents long-term fraying of the tooth cardboard, so compromising efficiency.

The invention will be more apparent from the description of one embodiment of the tear-off device and relative box, given hereinafter by way of example only. In the description, reference is made to the accompanying drawing, in which.

Figure 1:
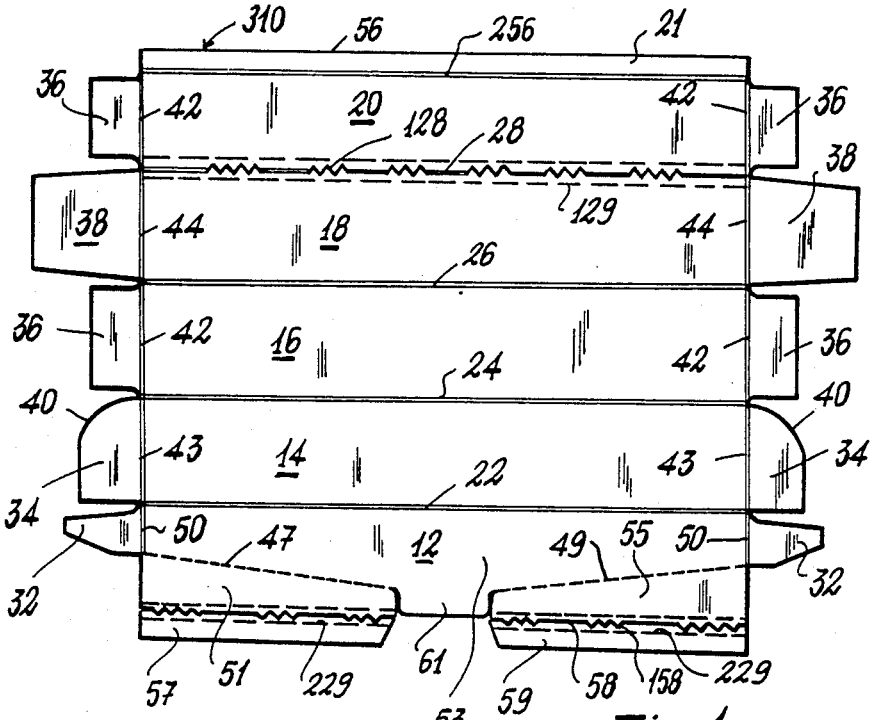
FIG. 1 is a punched sheet element for forming a box provided with the tear-off device according to the invention.

From FIG. 1 is can be seen that the punched sheet element 310 is composed of four substantially equal main portions 14, 16, 18 and 20 of elongated rectangular shape, separated by parallel creasing lines 24, 26 and 28.

The punched element 310 also comprises a secondary portion 12 of overall rectangular shape with dimensions substantially equal to those of said main portions and separated from the adjacent main portion 14 by a creasing line 22.

Each of the main portions 16 and 20 comprises a pair of opposing flaps 36 adjacent respectively to the short sides of said main portions and separated from them by relative creasing lines 42. The main portion 18 also comprises a pair of opposing flaps 38 but of greater length than the flap 36 and foldable about the relative creasing lines 44. The main portion 14 comprises a pair of opposing flaps 34 with a curved side 40, the flaps 34 being foldable about the creasing line 43.

The secondary portion 12 comprises two symmetrical inclined tearing lines 47 and 49 (indicated by dashed lines in FIG. 1) which divide the secondary portion 12 into three parts 51, 53 and 55, the central part 53 of the secondary portion 12 also comprising a pair of opposing flaps 32 foldable about the relative creasing line 50. The central part 53 contains a gripping tab 61 between the lateral parts 51 and 53 of the secondary portion 12. These latter parts each have a longitudinal flap (57, 59). The longitudinal flaps 57 and 59 are separated from the lateral parts 51 and 55 respectively by a creasing line 58. That face of the punched element 310 visible in FIG. 1 is that which will form the outside of the box 400 of FIG. 2.

Preferably during the punching operation itself, but otherwise subsequent to it, in corrspondence with the creasing lines 28 and 58 there are executed sawtooth cuts 128 and 158 which when the box 400 has been assembled (see FIG. 2) form a first toothing 128 and a second toothing 158. In the embodiment shown in the figures, these toothings are not continuous, the toothed portions 128 and 158 of the toothings being connected by respective creasing line portions 28 and 58.

The toothings could however be continuous, in which case the toothing must be formed such that the individual pairs of cuts which form each tooth are slightly spaced apart.

In the illustrated embodiment, the most outer main portion 20 of the punched element has a strip 21 which is separated from the remainder of the main portion 20 by the creasing line 256.

Figure 2:
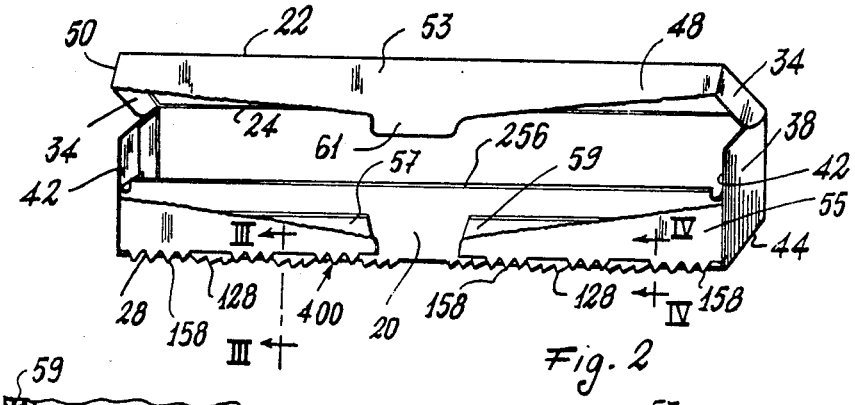
FIG. 2 is a perspective view of the box obtained from the punched element of FIG. 1

On folding the punched element 310 of FIG. 1 along its creasing lines 22, 24, 26, 28, 256, 58, 42, 43, 44 and 50, gluing that face of the flaps 36 visible in FIG. 1 to the non-visible face of the flaps 38, gluing the visible face of the flaps 32 to the non-visible face of the flaps 34, and finally gluing the visible face of the longitudinal flaps 57, 59 to the visible face of the main portion 20, the box 400 is obtained, as shown already open in FIG. 2. The longitudinal flaps 57 and 59 are folded below the secondary portion, and when the box has been assembled will therefore be located between this latter and the relative main portion 20, to which they are glued. However before carrying out these gluing operations the required roll of strip (not shown in FIG. 2) must firstly be placed in the box. Such rolls of strip are usually transparent polyethylene film, or aluminium or paper sheet, these being the materials usually used for wrapping foods.

When the box has been assembled, the toothings composed of the potions 128 and 158 will both be positioned along that long corner of the box 400 opposite the corner 24 about which the box lid can rotate once the box is opened (see FIG. 2).

Figure 4:
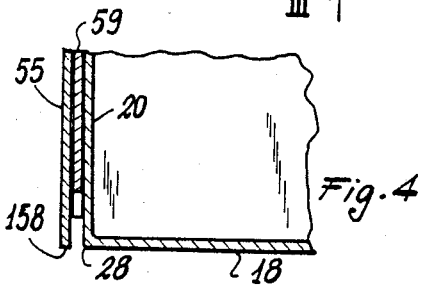
FIG. 4 is a cross-section therethrough on the line IV—IV of FIG. 2.
Figure 3:
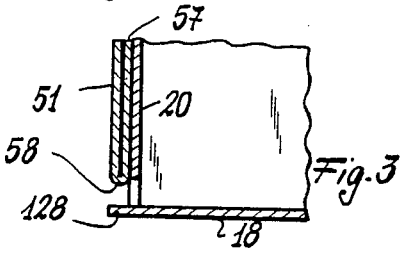
FIG. 3 is a partial cross-section through the box of FIG. 2 on this line III—III of FIG. 2.

The toothing portions 128 and 158 are formed such that along that portion of the creasing line 28 in which there are no teeth, the teeth of the other toothing are present and vice versa. The amount by which these teeth project beyond the edges of the box 400 is minimum or indeed zero, as can be seen in FIGS. 3 and 4.

To open the box 400 it is sufficient to grip the tab 61 with the fingers and pull it to tear the box along the tearing lines 47 and 49.

In this manner access is gained to the roll of strip inside. Having unrolled a portion of said strip of the desired length, it can be torn from the rest of the strip by applying it to the toothings 128 and 158 and exerting a tearing action, preferably beginning at one of its edges.

As stated, a given strip (129, 229) of the punched element (each shown in FIG. 1 by dashed lines) substantially centered about the relative creasing line 28, 58 and therefore about the relative toothing 128, 158 can be treated with a substance able to harden the cardboard of said strip, such as a glue. This is particularly so if a particularly large total of tear-off operations will be involved (such as in the case of large-diameter rolls of strip for tearing). This prevents the teeth fraying on account of the large number of tear-off operations, and compromising effectiveness.

I claim:

1. A parallelepiped box (400) containing a roll of tear-off strip material and provided with a device for tearing off a portion of said strip, said box being assembled from a punched sheet element (310) comprising:

four adjacent main portions (14, 16, 18, 20) formed from substantially equal elongated rectangles which are parallel to each other and separated by creasing lines (24, 26, 28) along their longer sides;

a secondary portion (12) of shape and dimensions substantially equal to those of said main portions and adjacent to one (14) of the two most outer main portions, with which it has in common one of its longer sides, along which there is provided a creasing line (22); and a pair of opposing flaps (32, 34, 36, 38), one at each end, which are rotatable about a creasing line provided along the relative short side of each main portion (14, 16, 18, 20) and secondary portion (12);

the main portions and secondary portion forming the outer lateral surface of the parallelepiped box (400), and said flaps (32, 34 46, 48) forming the two bases of said box, when the box has been assembled the secondary portion (12) being superposed on that main portion (20) which has one side free, the box being openable along said secondary portion (12) to define a lid formed substantially from the main portion (14) adjacent to the secondary portion, said lid being rotatable about that long side (24) of the lid main portion (14) more distant from the secondary portion, there being provided a toothing (128), formed by cutting through the punched element (310), along the creasing line (128) which forms that (28) of the box corners lying opposite the long corner about which the box lid can rotate; characterised in that all or part of that edge strip (51, 55) of said secondary portion (12) of the punched element on the side comprising said toothing remains fixed to the underlying main portion (20) when the box has been assembled, even after the box has been opened, and that the points of the teeth of the toothing (128) lie in the plane containing the outer surface of said edge strip (51, 55) or project just beyond said plane.

2. A box as claimed in claim 1, characterised in that the secondary portion (12) comprises one or more longitudinal flaps (57, 59) rotatable about a creasing line along that long side of the secondary portion (12) which is not in common with the adjacent main portion (14), when the box has been assembled the flap or flaps being interposed between the secondary portion (12) and the relative main portion (20).

3. A box as claimed in claim 1, characterised in that that edge of the secondary portion (12) which is not in common with the adjacent main portion (14) comprises a second toothing (158), the points of the teeth of this latter being located in the plane comprising the outer surface of that main portion (18) which when the box has been assembled is adjacent to the toothings (128; 158) and perpendicular to the secondary portion (12).

4. A box as claimed in claim 2, characterised in that the second toothing (158) is cut into the punched element (310) along the creasing line (58) which separates the secondary portion (12) from the relative longitudinal flaps (57, 59).

5. A box as claimed in claim 3 characterised in that the points of the teeth of the two toothings (128; 158) are staggered.

6. A box as claimed in any one of claims 3, characterised in that the first (128) and the second (158) toothing are not continuous, the toothed portions of the first toothing alternating with the toothed portions of the second toothing.

7. A box as claimed in claim 3, characterised in that the secondary portion (12) consists of three parts (51, 53, 55) separated by two symmetrically inclined tearing lines (47, 49), a first central part (53) forming part of the lid and provided with a tab (61) for gripping by the fingers, the other two lateral parts (51, 55) remaining fixed to the underlying relative main portion (20) after the box has been opened.

8. A box as claimed in claim 3, characterised in that a strip of the cardboard punched element (310) comprising a relative toothing (128, 158) is treated with a substance able to harden the cardboard.

9. A box as claimed in claim 4, characterised in that the first (128) and the second (158) toothing are not continuous, the toothed portions of the first toothing alternating with the toothed portions of the second toothing.

10. A box as claimed in claim 4, characterised in that the secondary portion (12) consists of three parts (51, 53, 55) separated by two symmetrically inclined tearing lines (47, 49), a first central part (53) forming part of the lid and provided with a tab (61) for gripping by the fingers, the other two lateral parts (51, 55 remaining fixed to the underlying relative main portion (20) after the box has been opened.

11. A box as claimed in claim 5, characterised in that the first (128) and the second (158) toothing are not continuous, the toothed portions of the first toothing alternating with the toothed portions of the second toothing.

12. A box as claimed in claim 11, characterised in that the secondary portion (12) consists of three parts (51, 53, 55) separated by two symmetrically inclined tearing lines (47, 49), a first central part (53) forming part of the lid and provided with a tab (61) for gripping by the fingers, the other two lateral parts (51, 55) remaining fixed to the underlying relative main portion (20) after the box has been opened.

13. A box as claimed in claim 5, characterised in that the secondary portion (12) consists of three parts (51, 53, 55) separated by two symmetrically inclined tearing lines (47, 49), a first central part (53) forming part of the lid and provided with a tab (61) for gripping by the fingers, the other two lateral parts (51, 55) remaining fixed to the underlying relative main portion (20) after the box has been opened.

* * * * *